United States Patent [19]

Levy

[11] Patent Number: 4,922,611

[45] Date of Patent: May 8, 1990

[54] KNIFE/FORK/SPOON COMBINATION CUTLERY

[76] Inventor: Isy Levy, 1015 33rd St., Apt. 406, NW., Washington, D.C. 20007

[21] Appl. No.: 385,068

[22] Filed: Jul. 26, 1989

[51] Int. Cl.[5] ..... A47J 43/28

[52] U.S. Cl. ..... 30/147; 30/148; 30/150

[58] Field of Search ..... 30/142, 147–150, 30/322–324

[56] References Cited

U.S. PATENT DOCUMENTS

| | | | |
|---|---|---|---|
| 96,134 | 10/1869 | McMorries | 30/148 |
| 1,324,565 | 12/1919 | Przybylek | 30/148 |
| 3,376,640 | 4/1968 | Kramer et al. | 30/148 |
| 4,131,994 | 1/1979 | Absher | 30/149 |

FOREIGN PATENT DOCUMENTS

| | | | |
|---|---|---|---|
| 116611 | 2/1918 | United Kingdom | 30/148 |

*Primary Examiner*—Douglas D. Watts
*Attorney, Agent, or Firm*—Richard C. Litman

[57] ABSTRACT

A cutlery apparatus incorporating the utility of a knife, a fork, and a spoon. The present invention combines a knife, fork, and spoon together in a unique and novel fashion so that a person may both impale and cut his food by the same apparatus. Moreover, the present invention is designed such that the operation may be accomplished by use of only one hand. The present invention incorporates a fork on a retractable shaft. The knife blade is disposed along the bottom most edge of a spoon disposed adjacent the fork. When activated, the spoon/knife combination rotates about the fork to cut the food item in which the fork is displaced. A gravity activated switching means is also incorporated in the present invention so that an individual may not activate the motorized cutlery device while eating. The device may be activated only when it is in a substantially vertical position with respect to the ground.

10 Claims, 3 Drawing Sheets

KNIFE/FORK/SPOON COMBINATION CUTLERY

BACKGROUND OF THE INVENTION

1. Field of the Invention

The present invention relates to the field of cutlery and associated accouterments. More specifically, the present invention relates to cutlery having multiple features and functions. The present invention incorporates the utility of a knife, a fork, and a spoon in a unique and novel fashion not disclosed in the prior art.

2. Description of the Prior Art

The prior art is reticent with a number of patents and inventions that describe the combination of a knife, a fork, and a spoon. In fact, U.S. Pat. No. 4,521,964 issued to T. Maruyama on June 11, 1985 is a typical example of such prior art. Maruyama teaches a number of cutlery items all based upon a scissor concept. Although exemplary of the prior art, the Maruyama invention has little if any relation to the present invention.

More applicable to the present invention are some of the U.S. Patents disclosing knives in combination with forks. U.S. Pat. No. 57,918 issued to J. S. Jennings on Sept. 11, 1866 is such a reference. The Jennings disclosure describes a knife pivotally connected to a fork that operates via a scissor action. The knife blade is forced into the food by the downward action of the scythe-type blade.

U.S. Pat. No. 96,134 issued to J. McMorries on Oct. 26, 1869 is more exemplary of the present invention. However, even the McMorries invention is far afield the present disclosure. McMorries describes a rotable, circular knife attached to a shaft. The fork is pivotally attached to the same shaft. Thus, when the food is impaled by the fork, the user can force the knife into the food and cause it to cut via a repetitive lateral motion. The present invention incorporates a fork in substantially the same axis as the shaft. Moreover, the present invention incorporates a motorized action wherein the knife rotates about the axis containing the fork. Thus, the present invention differs considerably from the McMorries disclosure.

U.S. Pat. No. 1,324,565 issued to A. Przybylek on Dec. 9, 1919 discloses a fork in combination with a knife. The actuation mechanism of the knife utilizes a gearing mechanism wherein the downward axial force of the user is translated into the rotary sweeping motion of the knife. A spring is included so that the knife may return to the rest position after the cut has been made. Przybylek differs from the present invention in many ways as well. However, the primary distinction between Przybylek and the present invention is the motion of the knife. The Przybylek knife operates much the same as the McMorries knife; it moves in a lateral direction. The present invention offers a combination of components wherein the knife moves in a rotary fashion about the axis of the fork.

U.S. Pat. No. 1,341,153 issued to E. G. Parker and R. Stroppel on May 25, 1920 and U.S. Pat. No. 1,585,533 issued to P. E. Coursen et. al. on May 16, 1926 each disclose forks in combination with knives. As with the Przybylek invention, these disclosures utilize knives which cut in a lateral direction. As a result, the present invention is equally distinguishable from this invention as it was from the Przybylek disclosure.

U.S. Pat. No. 3,376,640 issued to A. S. Kramer et. al. on Apr. 9, 1968 discloses a knife and fork combination wherein the knife is electromechanically operated. Save this single feature, the Kramer et. al. invention does not relate to the present invention. It is offered as an example of motorized cutlery.

The present invention offers a unique and novel approach to combination cutlery that is electromechanically operated. The present invention incorporates a fork an a fixed axis. A spoon is disposed adjacent the fork. The spoon has a cutting knife blade disposed at its bottom most portion. Upon actuation, the spoon/knife rotates about the fork to cut the material in which the fork is impaled. As a result, the food is cut to dimensions appropriate for consumption. The fork is spring loaded so that it extends beyond the cutting edge when the combination cutlery of the present invention is in a rest position.

SUMMARY OF THE INVENTION

Accordingly, it is an object of the present invention to provide a cutlery device which can operate as a knife.

It is another object of the present invention to provide a cutlery device which can operate as a fork.

It is still another object of the present invention to provide a cutlery device that can operate as a spoon.

It is yet another object of the present invention to provide a cutlery apparatus wherein the knife and fork operate in unison so that materials impaled by the fork may be cut by the knife. In this fashion, the present invention provides the user with a suitably sized item for consumption.

It is another object of the present invention to provide a knife/fork/spoon combination cutlery device which may be operated by one hand, leaving the other completely free.

It is still another object of the present invention to provide a cutlery device which has a knife whose operation is motorized.

It is yet another object of the present invention to provide a cutlery device that can be plugged into a standard wall socket.

It is another object of the present invention to provide a cutlery device which can be battery operated.

It is yet another object of the present invention to provide a fork that is retractable so that the knife blade may engage the food in which the fork is impaled.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

Similar reference characters designate corresponding parts throughout the various figures of the drawings.

DESCRIPTION OF THE PREFERRED EMBODIMENT

Figure 1:
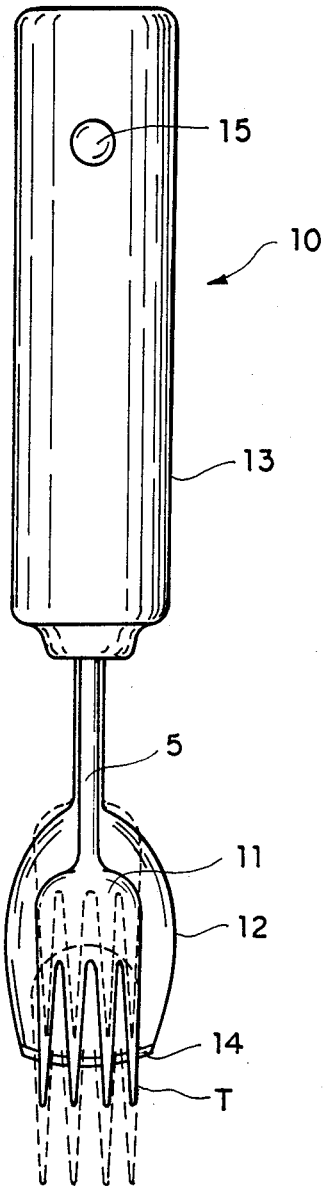
FIG. 1 is a front elevation view of the present invention.
Figure 2:
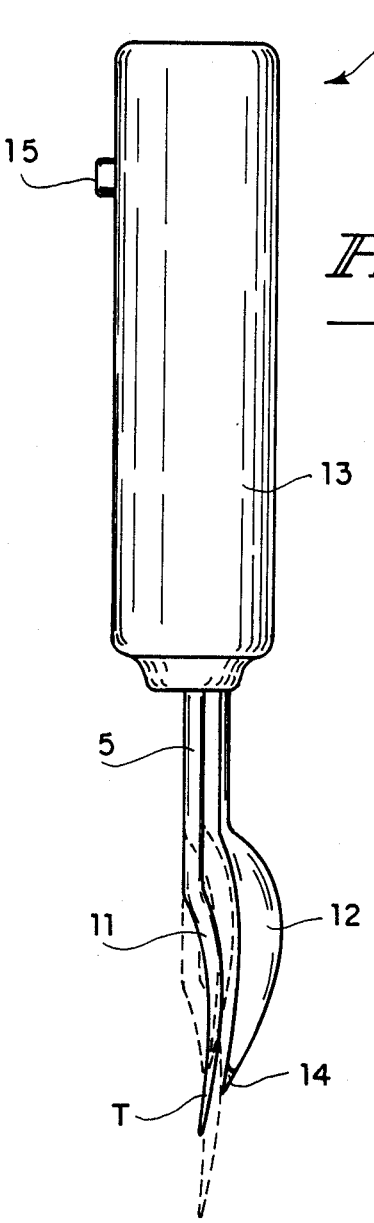
FIG. 2 is a side elevation view of the present invention.

The present invention of a cutlery apparatus is generally designated 10 in FIG. 1. The apparatus 10 is comprised of a number of primary components, namely a fork 11, a spoon 12, and handle 13. Disposed at the bottom most edge of the spoon 13 is a knife blade 14. A button 15 for the actuation of the mechanism contained within the handle 13 is disposed along the interior length of the handle 13. When the apparatus 10 is in a substantially vertical position, the button 15 can actuate the rotary mechanism of the spoon 12 with the knife blade 14 disposed thereon.

The fork 11 is substantially comprised of a shaft 5 with tines T disposed at the bottom most portion. The shaft 5 of the fork 11 is located substantially at the central axis of the handle 13. Also, the fork 11 is removably attached to the handle 13. The tines T act in the traditional manner as expected by a fork 11; they are used to impale food and bring it to the mouth of the user for consumption.

Located adjacent the fork 11 is the spoon 12. The spoon contains the knife blade 14 at its bottom most portion. The blade 14 is sharp enough to cut food, but it is not too sharp to provide a hazard to an individual. The blade 14 is designed to rotate about the axis of the fork 11. As a result, the blade 14 will cut a substantially circular piece of material from the food in which the fork 11 is impaled.

Figure 3:
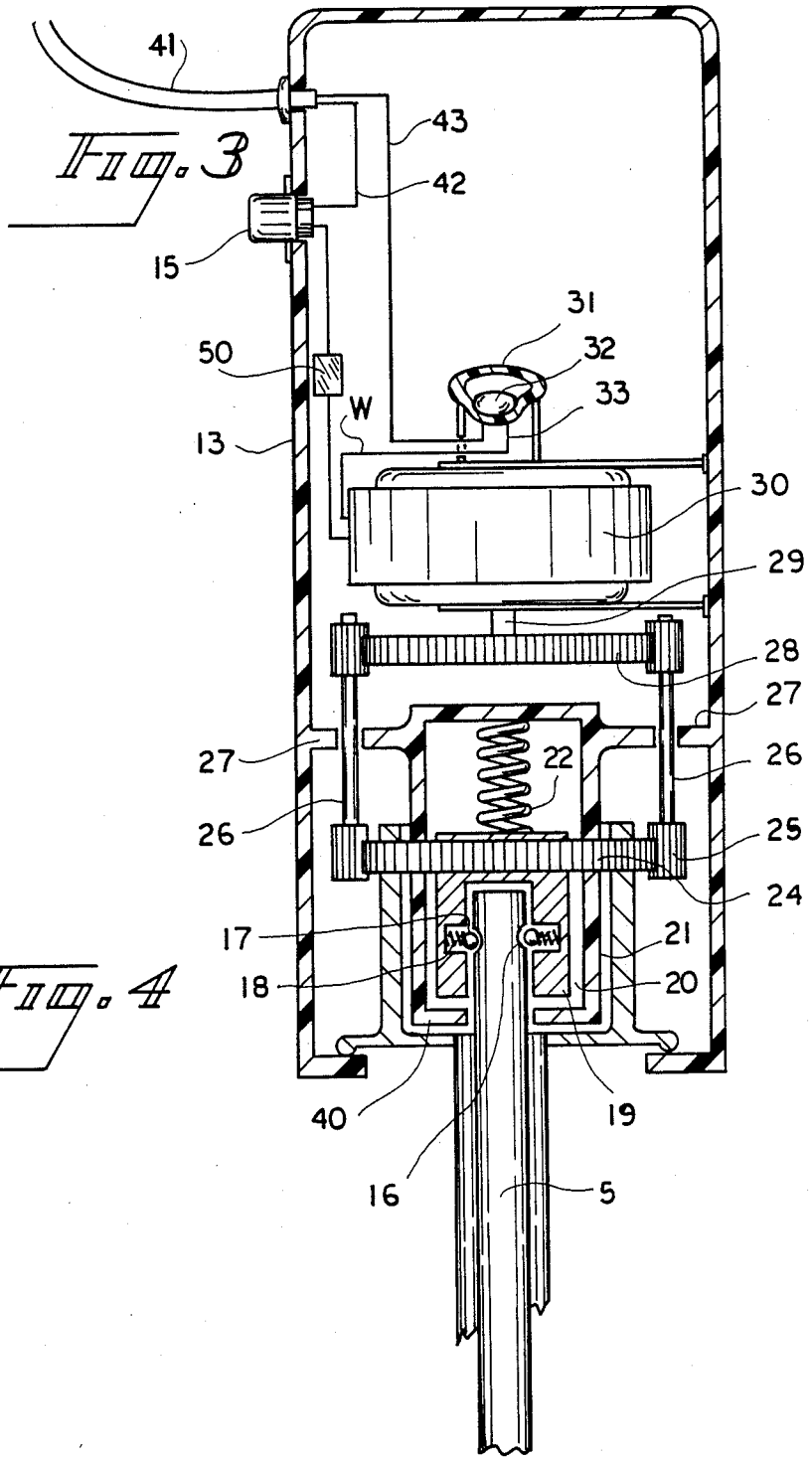
FIG. 3 is a cross-sectional view of the present invention showing the mechanism of operation as assembled for the embodiment of the present invention wherein it plugs into a standard electrical socket.

The shaft 5 of the fork 11 removably attaches to an attachment means within the handle 13. The shaft 5 contains at least on indentation 16 at its top most portion. As shown in FIG. 3, there are two indentations 16 provided on each side of the shaft 5. However, any number of indentations 16 that function in the appropriate manner will suffice. The indentation 16 is designed to accept a ball-shaped stop means 17. The ball shaped stop means 17 may be an item such as a ball bearing. However as with the number of indentations, any suitable component that will accomplish the purposes of the ball 17 will suffice.

The ball 17 is connected to a spring 18. Both the ball 17 and the spring 18 are located within an indentation with the attachment housing 19. The attachment housing is substantially a body having an opening at its lower most portion for acceptance of the shaft 5 of the fork 11. The ball 17 and spring 18 provide sufficient force to prevent the fork 11 from being inadvertently removed from the handle 13. However, they are designed to allow the fork 11 to be removed from the handle 13 should the user wish to use the spoon 12 solely.

The attachment housing 19 is located within a rigid housing 21 that is rigidly attached to the interior of the handle 13. The attachment housing 19 can move within the limited space located within the rigid housing 21. An air gap 20 is located between the rigid housing 21 and the attachment housing 19. The air gap 20 is a small region that allows the attachment housing 19 to slide along the longitudinal axis of the apparatus 10. A spring 22 is located between the rigid housing 21 and the attachment housing 19 at the top most portion of the attachment housing 19. The spring 22 applies a downward force to the top of the attachment housing 19 to push the housing 19 against the housing stops 40.

The combination of the attachment housing 19, the rigid housing 21, and the spring 22 provide the retractable action of the fork 11 during operation. The tips of the tines T of the fork 11, when the spring 22 has forced the attachment housing 19 against the housing stops 40, actually protrude beyond the edge created by the knife edge 14. In this fashion, food can be impaled without hindrance from the knife blade 14. However, due to the location of the spring 22, if a force is applied to the handle 13, the blade 14 can be forced against the surface of the food. In this manner, a downward force can be applied to the blade 14 to increase the effectiveness of the cut.

A motor 30 is located within the handle 13. the motor 30 provides the motive force behind the spoon 12 with the knife blade 14. The motor 30 has a drive shaft 29 extending therefrom. the drive shaft 29 has a drive gear 28 attached at its end. The drive gear 28 rotates at the speed of the motor 30. It is the rotary motion of the motor 30 that is transferred to the spoon 12 with the knife blade 14. The rotary motion that is transferred causes the knife blade 14 to rotate around the fixed axis of the fork 11.

The teeth of the drive gear 28 engage the teeth of two drive transmission gears 25. Though four drive transmission gears 25 are provided as described in FIG. 3, any number of such gears 25 may be used to assure proper functioning of the mechanism of the apparatus 10 of the present invention. Two drive transmission gears 25 are each located at opposing ends of a drive transmission shaft 26. The drive transmission shafts 26 are located about the inner periphery of the handle 13. The drive transmission shafts 26 provide the means by which the motive force of the motor 30 is transmitted to the knife blade 14.

Two drive transmission gears 25 are located each at one hundred eighty degrees apart from one another about the periphery of the drive gear 28. From each drive transmission gear 25, there is a drive transmission shaft 26 extending a partial length of the interior of the handle 13. The ends of the two transmission drive shafts 26 each contain a separate transmission drive gear 25. The drive shafts 26 are attached rigidly to the interior of the handle 13 by bearings 27. The bearings 27 are protrusions from the interior of the handle 13. Each of the bearings have holes bored therethrough for placement of the drive transmission shafts 26. Some lubrication may be needed to prevent excessive frictional force between the shafts 26 and the bearings 27.

The drive transmission gears 25 disposed at the bottom most portion of the drive transmission shafts 26 engage the ring gear 24 which surrounds the rigid housing 21. The spoon 12 attaches to the bottom of the ring gear 24 at its top most portion. Thus, when the ring gear 24 is rotated by the motor 30, the spoon 12 with the knife blade 14 disposed thereon will also rotate.

Electrical power may be supplied to the present invention via two primary fashions. As shown in FIG. 3, the electrical power is supplied by a standard electrical cable 41. As with all electrical devices, there is an input wire 42 and an output wire 43. Each of these wires 42 and 43 extend into the handle 13 and connect to the electrical components therein.

Figure 4:
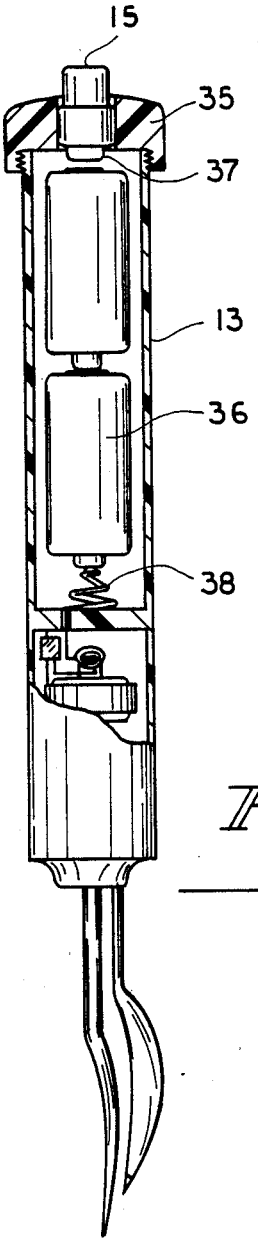
FIG. 4 is a cross-sectional view of the present invention showing the mechanism of operation and the chamber contained within the handle wherein batteries may be disposed.

FIG. 4 pictorially describes the embodiment of the present invention wherein the electrical power is supplied by batteries 36. The batteries 36 are disposed within the handle 13. Any number of batteries 36 may be used, though two are shown for simplicity. The batteries 36 are inserted into the handle 13 through an opening at it top most portion. A screw-on cap 35 is provided to hold the batteries 36 in place within the handle 13. Spring 38 is provided at one end of the battery chamber to provide the compressive force needed to hold the batteries 36 in contact with one another. The other end of the battery chamber contains a contact plate 37 to provide the electrical power to the apparatus 10.

The power source, whether it be accomplished by an electrical power cord 41 or batteries 36 is connected to a switch 15. The switch 15 is simply a button disposed along the length of the handle 13 that allows the electrical energy to pass to the motor. By actuation of the switch 15, the motor will operate. If the switch 15 is not activated, the motor is at rest.

Wires W extend from the switch 15 to a processor 50. The processor 50 is provided so that the spoon 12 will always return to the same rest position regardless of the number of rotations it may make in order to cut food. The processor 50 will sense the deactivation of the switch 15 and continue to provide power to the motor until the spoon 12 comes to rest. The rest position of the spoon 12 is pictorially described in FIG. 1. Namely, the spoon 12 is designed to come to rest behind the fork 11. In this manner, the spoon 12 will never hinder consumption by stopping in another position.

Power travels from the processor 50 to the gravity switch 31. The gravity switch 31 is composed of a chamber having a narrow base portion and a bulbous upper portion. Two leads 33 extend into the narrow base portion of the gravity switch 31. A liquid mercury bubble 32 is enclosed within the body of the gravity switch 31. When the mercury bubble 32 sits in the narrow base portion of the gravity switch 31, it can electrically connect the leads 33. If the mercury bubble 32 rests in the bulbous upper portion on the switch 31, the leads 33 are not connected electrically and the motor 30 can not operate.

The gravity switch 31 is incorporated into the present invention as a safety mechanism. The gravity switch 31 is position so that the narrow base portion containing the leads 33 points to the bottom of the handle 13 in the direction of the fork 11. When the apparatus 10 is in a substantially vertical position, the mercury bubble 32 will be pulled by gravity to connect the leads 33. If the handle 13 is tilted in any way, as it would be were someone placing the fork 11 into his mouth, the mercury bubble 32 will travel to the bulbous portion of the switch 31 and the motor 30 can not be activated. Thus, unless the handle 13 is vertically disposed, the motor 30 can not work, because it can not receive electrical power. A person can not accidentally activate the mechanism and damage his mouth.

A wire extends from the motor 30 to the gravity switch 31 and terminates at one of the leads 33. Another wire W extends from the other lead 33 to the power supply to complete the circuit. As is well known, any break in the circuit will prevent the system from working. The switch 15 and the gravity switch 31 act as the electrical control mechanisms of the apparatus 10. Unless the switch 15 is activated and the gravity switch 31 functions to complete the circuit, the motor 30 will not operate. Thus, the switch 15 and the gravity switch 32 assure operation of the apparatus 10 only when needed. The two switches 15 and 31 provide the redundancy needed to create a safe and effective cutlery device 10.

Figure 5:
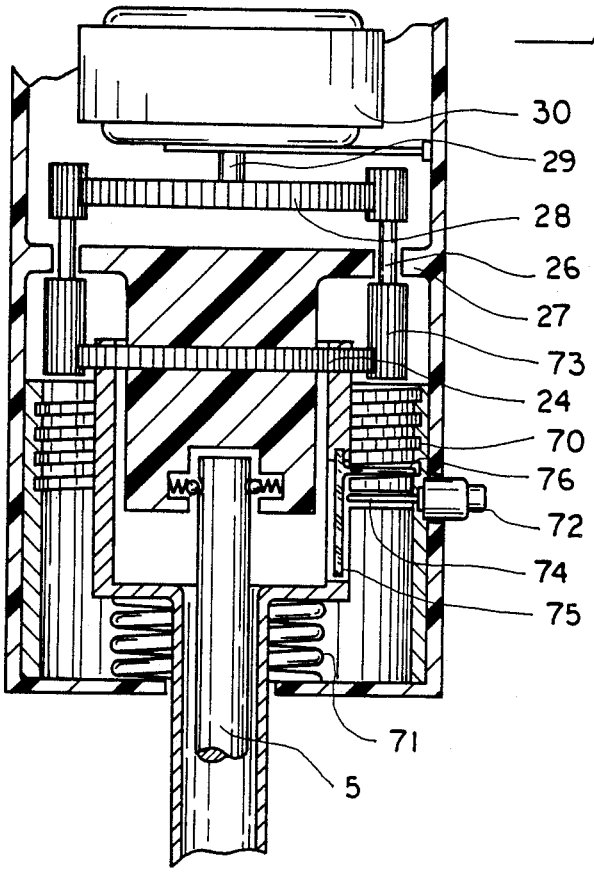
FIG. 5 is a cross-sectional illustration of an alternate embodiment of the present invention wherein the knife blade rotates downwardly from its rest position.

FIG. 5 shows pictorially an alternate embodiment of the present invention. In this case, the knife blade 14 is forced downward into the food material by a screw track 70. The screw track 70 directs the knife blade 14 in a slow downward spiral fashion. In this way, the fork need not be retractable. In order to bring the knife 14 back to its rest position, the blade may be reverse wound by the motor. Alternate means may be provided wherein the knife 14 is snapped back to its rest position by a spring 71 and switch 72. The drive transmission gears 73 are elongated so that the ring gear 24 does not disengage the gears 73 when the knife 14 travels in its downward spiral.

The switch 72 has a post 74 that engages the retractable plate 75. When the post 74 touches the plate 75 inwardly, the track engagement post 76 is drawn out of the track 70. This is due to the fact that the track engagement post 76 is connected to the plate 75. When the post 76 is pushed out of the track 70, the knife 14 no longer engages the track 70 and the spring 71 can push the knife 14 back to the rest position whereupon the procedure may be repeated.

It is to be understood that the present invention is not limited to the sole embodiment described above, but encompasses any and all embodiments within the scope of the following claims.

I claim:

1. A cutlery apparatus comprising:

a cutlery handle, a removable fork removably engaging said cutlery handle, a cutting means disposed adjacent said fork and rotably attached to said cutlery handle, said removable fork having a plurality of tines there attached allowing for the removable attachment of materials thereto, said removable fork having a substantially fixed position in relation to said cutlery handle, a motor means disposed within said cutlery handle, a gravity actuated switching means disposed within said cutlery handle, said gravity actuated switching means electronically connecting to said motor means, a switching means disposed through said cutlery handle, said switching means electronically connecting to said motor means, said switching means activating said motor means, said gravity actuated switching means allowing for operation of said motorized means only when said cutlery apparatus is in a substantially vertical position and said switching means is activated, wire means electronically connecting said switching means, said motor means, and said gravity actuated switching means, said motor means rotably driving said cutting means around the axis defined by said fork, and a power means electronically connecting to said motor means providing the electrical input needed to actuate said motor means.

2. A cutlery apparatus according to claim 1, wherein:

said cutting means being a spoon, said spoon disposed adjacent said fork and rotably attached to said cutlery handle, and said spoon having a knife blade disposed at the bottom most portion thereof.

3. A cutlery apparatus according to claim 1, wherein:
said removable fork having a shaft,
said shaft having at least one indentation disposed thereon,
said indentation removably engaging an attachment means,
said shaft inserting into an attachment housing having said attachment means disposed therein,
said attachment housing having limited movable capability within said cutlery handle allowing for longitudinal motion of said fork along the central axis defined by said cutlery handle,
said attachment housing disposed within a rigidly fixed housing attached to the interior of said cutlery handle, and
a spring means disposed between said attachment housing and said rigidly fixed housing allowing for limited retraction and limited extension of said fork when a force is applied thereto.

4. A cutlery apparatus according to claim 1, wherein:
said attachment means for said fork being at least one rigid sphere,
said rigid sphere engaging a spring means,
a restrictive depression containing said rigid sphere and said spring means preventing inadvertent removal of said rigid sphere and said spring means from said restrictive depression,
said restrictive depression forming a channel within which said rigid sphere and said spring means have limited lateral motion, and
said rigid sphere removably engaging said indentation on said shaft of said fork to hold said fork within said cutlery handle.

5. A cutlery apparatus according to claim 1, wherein:
said motor means having a drive shaft,
said drive shaft attaching to a drive gear,
said drive gear toothedly engaging at least one power transmission gear means,
said power transmission gear means attaching to one end of a power transmission drive shaft,
said power transmission drive shaft having a toothed gear disposed at the end opposite that having said power transmission gear means,
said toothed gear toothedly engaging a ring gear,
said ring gear means rigidly attaching to said cutting means at its top most portion, and
said ring gear means providing rotary motion to said cutting means.

6. A cutlery apparatus according to claim 5, wherein:
said cutlery handle including two power transmission gear means.

7. A cutlery apparatus according to claim 1, wherein:
said power means being an electrical cord allowing transmission of electrical power to said power means, and
said electrical cord removably engaging an electrical outlet.

8. A cutlery apparatus according to claim 1, wherein:
said power means being at least one battery disposed within said cutlery handle, and
said battery providing electrical power to said motor means.

9. A cutlery apparatus according to claim 1, wherein:
said gravity actuated switching means being an enclosed chamber,
said enclosed chamber having a narrow base portion,
said enclosed chamber having a bulbous upper portion attached to said narrow base portion,
said narrow base portion having two conductive leads disposed therethrough,
said conductive leads being disposed adjacent one another without touching,
said enclosed chamber containing a predetermined amount of liquid mercury,
said liquid mercury when disposed by gravity to said narrow base portion of said enclosed chamber electrically connecting said conductive leads allowing for an uninterrupted flow of current from one of said leads to the other,
said liquid mercury when disposed by gravity to said bulbous upper portion preventing the electrical connection of said leads,
whereby said apparatus must be oriented in a substantially vertical position for said liquid mercury to electrically connect said leads, and
whereby said leads must be electrically connected by said liquid mercury for said motor means to operate.

10. A cutlery apparatus according to claim 1, wherein:
said cutlery handle having a spiral track disposed therein disposed about the periphery thereof,
said cutting means having a track engagement post disposed thereon,
said track engagement post disposed on a movable plate disposed on a portion of the periphery of said cutting means,
wherein said spiral track guides said cutting means in a downward direction when said track engagement post engages said spiral track,
said track engagement post being removably engagable with said spiral track by a track disengagement switching means disposed through said cutlery handle, and
whereby the disengagement of said track engagement post from said spiral track allows said cutting means to return to the rest position via a return spring means.

* * * * *